United States Patent [19]

Taumann

[11] 4,327,293

[45] Apr. 27, 1982

[54] ELECTRON ACCELERATOR AND TARGET WITH COLLIMATOR

[75] Inventor: Leonhard Taumann, Lafayette, Calif.

[73] Assignee: Siemens Medical Laboratories, Inc., Walnut Creek, Calif.

[21] Appl. No.: 143,156

[22] Filed: Apr. 23, 1980

[30] Foreign Application Priority Data

Jul. 3, 1979 [DE] Fed. Rep. of Germany ..... 2926841

[51] Int. Cl.[3] ..... H05H 7/12; H01J 35/00; G21K 1/00

[52] U.S. Cl. ..... 250/505; 250/510

[58] Field of Search ..... 250/510, 505

[56] References Cited

U.S. PATENT DOCUMENTS 4,121,109 10/1978 Taumann et al. ..... 250/505

4,157,475 6/1979 Stock et al. ..... 250/505

*Primary Examiner*—Alfred E. Smith

*Assistant Examiner*—T. N. Grigsby

*Attorney, Agent, or Firm*—Spellman, Joel & Pelton

[57] ABSTRACT

The invention relates to a radio therapy apparatus comprising an electron accelerator having a target and a collimator for limiting the X-ray cone. In the use of such electron accelerators, the radiation load of the patient is increased in an undesirable manner by neutrons in addition to the therapeutically desired roentgen quanta. To reduce the neutron level the invention provides that the edge zone of the collimator facing the target is made of a material of low effective cross-section for (gamma, n) processes. The dimension of this edge zone material approximately corresponds to the half-value depth of the X radiation in this material.

5 Claims, 1 Drawing Figure

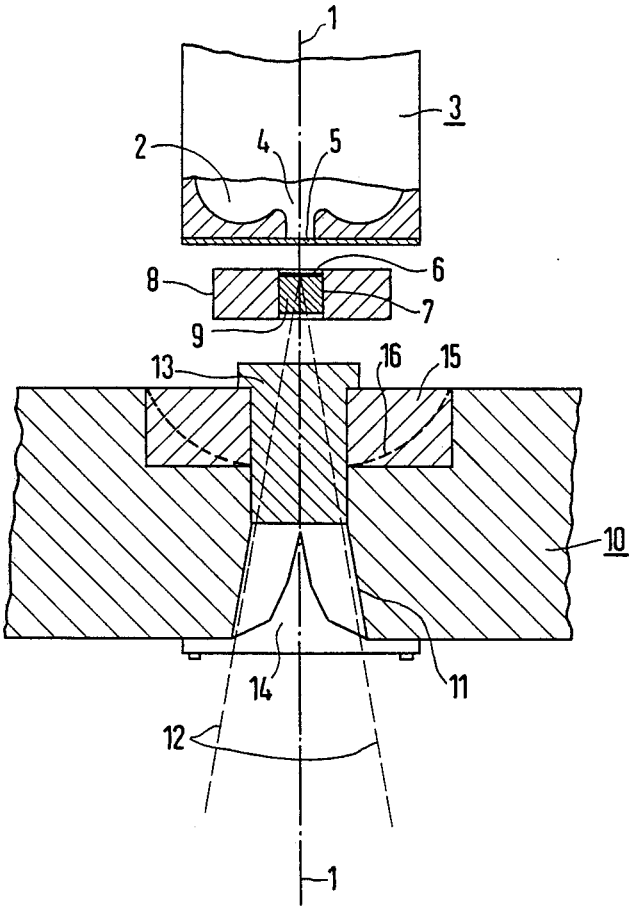
1
3
2
4
5
6
8
7
9
13
16
15
10
14
11
12
1

ELECTRON ACCELERATOR AND TARGET WITH COLLIMATOR

The invention relates to an electron accelerator for radio therapy apparatus and including a target exposed to the electron beam issuing from the acceleration tube, an electron absorber following the target in beam direction, a collimator for masking an X-ray cone, and a compensation body centered on the masking aperture of the collimator.

BACKGROUND OF THE INVENTION

In U.S. Pat. No. 4,121,109 there is disclosed an electron accelerator intended for use in radio therapy. To generate X radiation in this electron accelerator, a target is exposed to the electron beam issuing from the acceleration tube. Behind the target, in beam direction or in the path thereof, there are arranged an electron absorber, in which the remaining electrons are filtered out of the X radiation, and a collimator with a passage aperture for masking out the maximun, usually conical X-ray field being used. A compensation body is positioned in the beam passage aperture of the collimator by which the dosage output of the issuing X radiation is equalized over its entire cross-section. In such electron accelerators there is a disadvantage however that, in addition to the therapeutically desired roentgen quanta, neutrons also are produced which increase the radiation load of the patient undesirably.

NATURE OF THE INVENTION

It is an object of the invention to limit the radiation load of the patient to what is therapeutically necessary and in particular to reduce the neutron radiation load.

In an electron accelerator of the above-mentioned kind, therefore, the edge zone of the collimator toward the target is made, according to the invention, of a material of low effective cross-section for (gamma, n) processes, to reduce neutron generation. This solution is based on the surprising finding that the neutrons are generated only in very small part in the parts installed in the useful ray cone, i.e. the target, the electron absorber, or the compensation body. The bulk of the neutrons is generated on the side of the collimator toward the ray source. The neutrons generated there pass through the collimator and lead to the observed diffused radiation of the surroundings. The use of a material of low effective cross-section for (gamma, n) processes for the edge zone of the collimator toward the target leads to a very decisive reduction in the total number of neutrons generated per unit time. As isotopes of low effective cross-section for (gamma, n) processes are generally to be found among the elements of low atomic number, they are not suitable for X-ray collimators. In other words, especially for collimators it is customary, because of the better X-ray absorption, to use materials which have a higher atomic number and hence also a very much higher effective cross-section for (gamma, n) processes. By the limitation of the use of material of low effective cross-section for (gamma, n) processes to the areas of the collimator facing the target, the specific absorption properties of the collimator for X-rays are, on the one hand, lessened in only small degree which can still be compensated by increasing the wall thickness, and at the same time the generation of neutrons precisely in those regions with greater X-ray density is reduced, or, depending on the type of material used and the maximally used quantum energy, suppressed completely.

In appropriate development of the invention, the edge zone made of material of low effective cross-section for (gamma, n) processes, may have radially to the target a dimension which approximately corresponds to the half-value depth of the X radiation in this material. By radially is meant within the cone or conical shape of beam radiation from the target. This relation gives a good criterion for the optimation of the collimator. In the lower layers of the collimator, i.e. after passage through the half-value depth for the X radiation, only a comparatively low roentgen guantum density and hence a lower generation rate for the neutrons is to be expected, both because of the absorption of the X radiation and because of the square law. Those parts, therefore, may be made of a heavy metal such as tungsten or lead which shields the roentgen quanta well, without material effect on the neutron production.

Another optimation of the collimator can be achieved by having the edge zone, made of material of low effective cross-section for (gamma, n) processes, extend perpendicular to the direction of the axis of symmetry of the masking aperture to a distance from the target which is approximately 1.5 times the distance between the target and the edge of the collimator masking aperture nearest the target. This leads to the result that only a relatively small portion of the collimator need be made of a material which is less absorbant of X-rays. The zones of the primary collimator farther removed from the target are energized with a lower roentgen quantum density, because of the square law, so that in this region fewer neutrons are generated by (gamma, n) processes. Accordingly it is not necessary to line such zones with a material of lower effective cross-section for (gamma, n) processes since such a measure would not result in a reduction of the neutron production sufficiently to warrant accepting poorer X-ray absorption.

Further details of the invention will be explained in greater detail with reference to the embodiment shown in the drawing.

THE DRAWING

The single FIGURE of the drawing shows a schematic cross sectional representation of an electron accelerator with a target for the generation of X-ray beams radiation and with a collimator constructed in accordance with the invention for the masking of an X-ray cone.

DETAILED DESCRIPTION OF THE PREFERRED EMBODIMENT

In the drawing there is seen the beam exit end of an acceleration tube 3 of an electron accelerator, sectionalized in the plane of the axis of symmetry 1 of the last cavity resonator 2 of such tube. In the sectional plane there is seen the cylindrical-symmetrical form of the last cavity resonator 2 with the electron beam 4 accelerated along the axis of symmetry, and including the electron-transmitting window 5 which seals the acceleration tube on the exit side vacuumproof.

In beam direction beyond the window 5, is a gold foil target 6. The target 6 is mounted within a bore or central opening 7 in a support plate 8. Directly behind the target a first electron absorber 9 is also provided within the bore 7 of the support plate 8. The absorber 9 consists of a carbon disk approximately 20 mm thick.

In beam direction beyond this electron absorber there is a collimator 10 for the X radiation. The collimator 10 is provided with a conical masking aperture 11 for passage of the maximum useful cone shaped ray 12. The section of this conical masking aperture 11 toward the target is cylindrically drilled open to receive another electron absorber 13 made of aluminum. Behind this additional electron absorber 13, a compensating body 14 is secured on the collimator 10, extending into the conical masking aperture 11 thereof.

The edge zone of the conical masking aperture 11 of the collimator 10 facing the target 6 is machined out cylindrically. A ring-shaped body 15 of a well known material of low effective cross-section for (gamma, n) processes and of matching external dimensions, is placed within the resultant opening. The thickness of this ring-shaped body 15 is selected expediently approximating in beam direction the half-value depth for roentgen quanta in this material. The diameter or cross-sectional length of this ring-shaped body 15 perpendicular to the axis of symmetry 1 of the conical masking aperture 11 of the collimator 10 extends to a distance from target 6 which is 1.5 times as large as the distance of target 6 from the nearest edge section.

As the electron accelerator is put into operation, the accelerated electrons which have passed through the window 5 of the acceleration tube 3 impinge on target 6 and there generate X-ray beams radiation. Due to (gamma, n) processes, the roentgen quanta thus generated also generate neutrons in target 6. This is unavoidable, because those elements of higher atomic number which have a good efficiency in the generation of roentgen quanta also have a low energy threshold and at the same time a relatively high effective cross-section for (gamma, n) processes. Yet the total number of neutrons generated in target 6 is negligibly small because of the relatively small volume of the target, in the present case a gold foil about 0.3 mm thick. The other elements located in the useful ray cone 12, such as electron absorbers 9 and 13 and compensation body 14, are made of carbon, iron or aluminum having inherently a lower effective cross-section for (gamma, n) processes, therefore contributing negligibly to the generation of neutrons.

Because of the required high absorption coefficient for X radiation, the collimator 10 is made of a material of high atomic number, preferably tungsten, uranium or lead. Also, irradiated volume thereof is relatively large. Generally 80% of all neutrons generated in such installations are generated in this collimator, the main contributor to the neutron generation being the areas of the collimator in which the roentgen dose efficiency is particularly high. These are in particular the collimator regions nearest the target 6. The neutron production rate decreases in direct proportion to the roentgen quantum density of the material of the collimator.

If the material usually used at the upper aperture of the collimator 10 is replaced by a body 15 of a material of low effective cross-section for (gamma, n) processes to a depth corresponding to the half-value depth for X-rays, the neutron production is reduced relatively strongly at minimal material exchange. In beam direction behind this ring-shaped body 15 the density of the roentgen quanta will have dropped sufficiently so that replacement of the lower region also by a material of low effective cross-section for (gamma, n) processes is not necessary. In fact, any resulting additional slight reduction of the neutron production would be obtained at the cost of a more significant reduction of X-ray shielding.

For maintaining good X-ray shielding, the lateral extension of the ring-shaped body 15 transversely to the axis of symmetry 1 of the conical aperture 11 of the collimator 10 should be limited to a distance from the target 6 which corresponds approximately to 1.5 times the distance of the target from the nearest edge section of the aperture of the collimator. Also in this case a further enlargement of the ring-shaped body 15 transversely to the axis of symmetry 1 of the masking aperture would bring about only a relatively slight further reduction of the neutron production.

Although somewhat more expensive in terms of manufacture, a particularly expedient utilization of the material of low cross-section for (gamma, n) processes results therefore when the annular body 15 is given the form of a spherical dome 16 the spherical part of which is directed toward the lower part of the collimator 10.

As material for the body 15 of low effective cross-section for (gamma, n) processes there may be named carbon, aluminum, beryllium, calcium, iron and with some limitations also copper. While carbon and aluminum have especially lower effective cross-sections for (gamma, n) processes, for iron and copper as is known, there exists a lower range of the roentgen quanta, which to some extent compensate the disadvantage of the somewhat greater effective cross-section for (gamma, n) processes, referred to the dimension of the selected shielding.

While a preferred embodiment has been described modifications are possible within the scope of the following claims.

What is claimed is:

1. An electron accelerator structure comprising an acceleration tube, a target exposed to the electron beam issuing from said tube, and a collimator having an aperture for masking an X-ray cone, characterized in that the edge zone of the collimator toward the target is made of a material of low effective cross-section for (gamma, n) processes, whereby neutron generation is reduced, said edge zone having radially to the target a dimension which approximately corresponds to the half-value depth of the x-radiation in this material.

2. An electron accelerator structure according to claim 1, characterized in that the edge zone made of material of low effective cross-section for (gamma, n) processes extends perpendicular to the direction of the axis of symmetry of the masking aperture a distance which is approximately 1.5 times the distance between the target and the edge of the masking aperture of the collimator nearest the target.

3. An electron accelerator structure according to claim 1, characterized in that the edge zone is annular and of rectangular cross-section.

4. An electron accelerator structure according to claim 1, characterized in that the edge zone has the form of a spherical dome with a central bore.

5. An electron accelerator structure according to claim 4, characterized in that the center of the sphere is axially coincidental with the target.

* * * * *